US009073056B2

(12) United States Patent
Abeln

(10) Patent No.: US 9,073,056 B2
(45) Date of Patent: Jul. 7, 2015

(54) COMMINUTION DEVICE

(75) Inventor: Michael Abeln, Halen (DE)

(73) Assignee: Hugo Vogelsang Maschinenbau GmbH, Essen (DE)

( * ) Notice: Subject to any disclaimer, the term of this patent is extended or adjusted under 35 U.S.C. 154(b) by 94 days.

(21) Appl. No.: 13/821,260

(22) PCT Filed: Sep. 9, 2011

(86) PCT No.: PCT/EP2011/065691

§ 371 (c)(1),
(2), (4) Date: May 24, 2013

(87) PCT Pub. No.: WO2012/032175

PCT Pub. Date: Mar. 15, 2012

(65) Prior Publication Data

US 2013/0228640 A1 Sep. 5, 2013

(30) Foreign Application Priority Data

Sep. 9, 2010 (DE) ..... 20 2010 012 373 U
Sep. 13, 2010 (DE) ..... 20 2010 012 495 U

(51) Int. Cl.
*B02C 18/16* (2006.01)
*B02C 18/06* (2006.01)
(Continued)

(52) U.S. Cl.
CPC ..... *B02C 18/16* (2013.01); *B02C 2018/164* (2013.01); *B02C 18/062* (2013.01);
(Continued)

(58) Field of Classification Search
CPC ..... B02C 18/062; B02C 2018/164; D21D 1/306; D21D 1/30
USPC ..... 241/46.017, 46.06, 46.17, 69, 101.3, 241/86, 88, 88.1, 89.4, 82.7, 46.04
See application file for complete search history.

(56) References Cited

U.S. PATENT DOCUMENTS 2,012,680 A * 8/1935 Hammes ..... 241/46.06
2,365,904 A * 12/1944 Peake ..... 241/46.04
(Continued)

FOREIGN PATENT DOCUMENTS

DE 3939213 A1 5/1990
DE 19700183 A1 7/1997
(Continued)

OTHER PUBLICATIONS

International Search Report dated May 8, 2012 in Application No. PCT/EP2011/065691.
(Continued)

*Primary Examiner* — Faye Francis
(74) *Attorney, Agent, or Firm* — Kilpatrick Townsend & Stockton LLP; Dean W. Russell

(57) ABSTRACT

Described is a comminution device, in particular a comminution device including an adjusting mechanism, the adjusting mechanism including a hydraulic cylinder which is coupled between the first and the second cutting element and is in hydraulic communication with a closed hydraulic and pneumatic volume, which is filled with a hydraulic fluid in a first part and with air in a second part, and the wall of which is at least partially transparent so that the hydraulic fluid level can be read from a scale which displays a wear condition of the first and second cutting element.
Also detailed is a comminution device in which a lubricant-filled cavity is formed between a first area and a second area, the volume of the cavity being reduced by an adjusting movement of the second cutting element and which is in fluidic communication with the positive engagement connection in order to supply lubricant to the positive engagement connection.

18 Claims, 10 Drawing Sheets

Figures 1, 2:
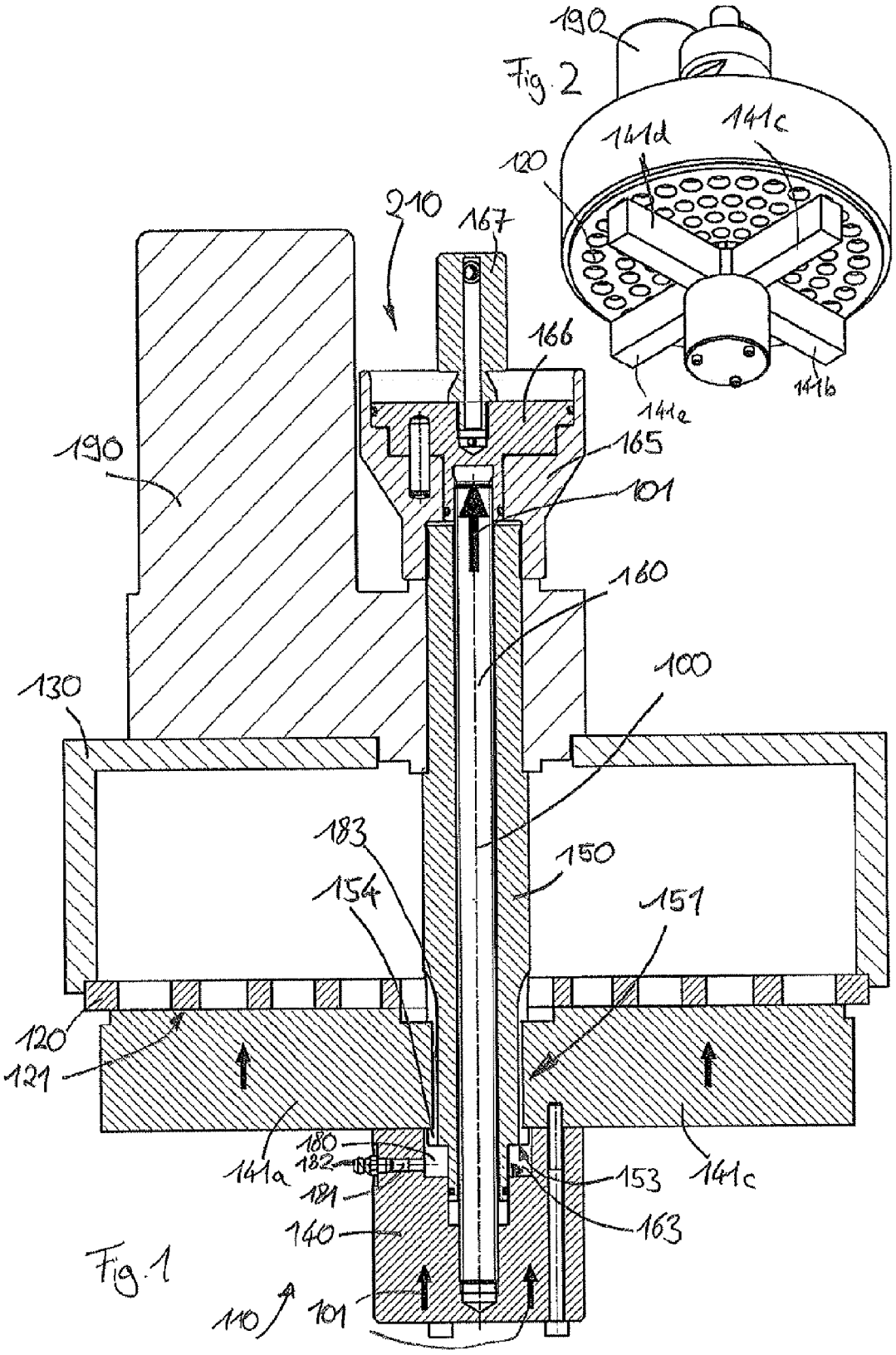

(51) Int. Cl.

| | |
|---|---|
| ***D21D 1/30*** | (2006.01) |
| ***B02C 18/00*** | (2006.01) |
| ***B02C 18/18*** | (2006.01) |

(52) U.S. Cl.

CPC ..... *D21D 1/30* (2013.01); *D21D 1/306* (2013.01); *B02C 18/0092* (2013.01); *B02C 18/18* (2013.01); *B02C 2210/01* (2013.01)

(56) References Cited

U.S. PATENT DOCUMENTS

| | | | | | |
|---|---|---|---|---|---|
| 2,716,926 | A | * | 9/1955 | Armstrong | 241/46.06 |
| 4,637,555 | A | * | 1/1987 | Furuichi et al. | 241/46.02 |
| 5,044,566 | A | * | 9/1991 | Mitsch | 241/46.04 |
| 5,346,143 | A | * | 9/1994 | Askin | 241/46.017 |
| 5,707,016 | A | * | 1/1998 | Witsken | 241/46.06 |
| 2012/0091243 | A1 | | 4/2012 | Abeln | |

FOREIGN PATENT DOCUMENTS

| | | | |
|---|---|---|---|
| DE | 29910596 | U1 | 9/1999 |
| DE | 202009003995 | U1 | 8/2010 |
| WO | 2010108932 | A1 | 9/2010 |

OTHER PUBLICATIONS

China Patent Application No. 201180043217.5, Redacted Translation of Office Action dated Mar. 26, 2014, 6 pages.

Australia Patent Application No. 2011301211, Office Action dated May 30, 2014, 4 pages.

* cited by examiner

190

141d
141c
120
141e
141b
210
167
166
165
101
190
160
100
130
183
150
154
151
120
121
180
182
181
141a
153
141c
163
140

110
101

A-A

Fig. 13
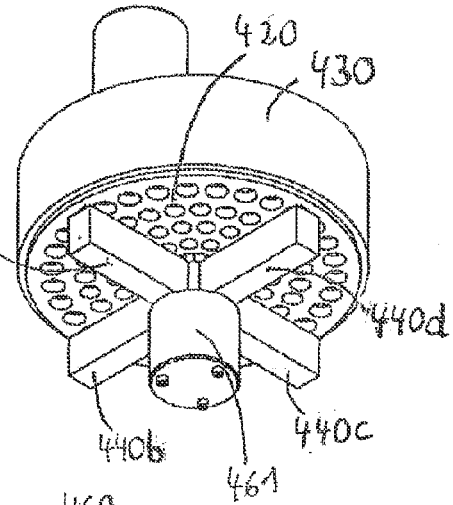
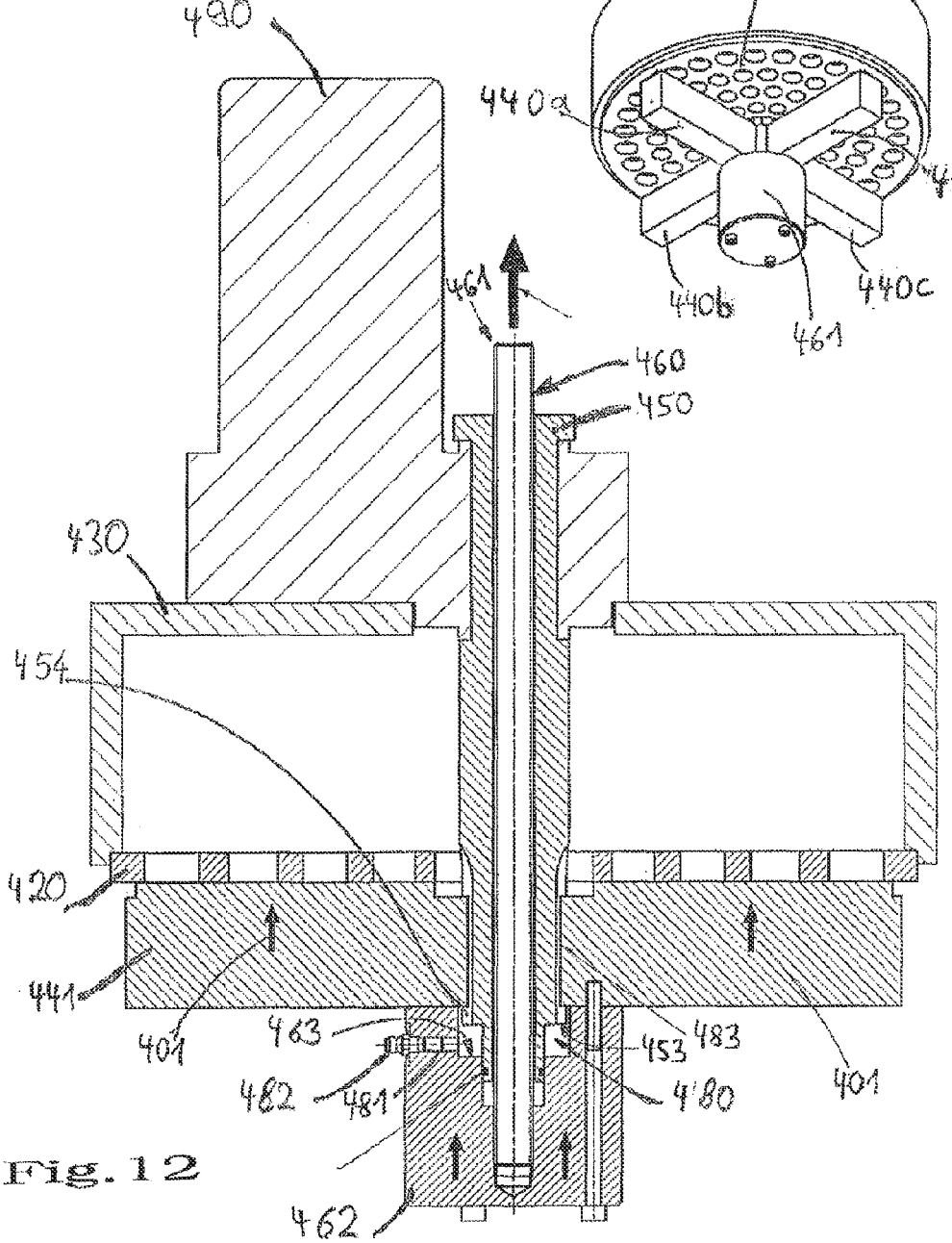
Fig. 12

COMMINUTION DEVICE

CROSS REFERENCE TO RELATED APPLICATIONS

This application is the U.S. national phase of International Application No. PCT/EP2011/065691 filed on Sep. 9, 2011, which application claims priority to German Patent Application No. 202010012373.9 filed on Sep. 9, 2010 and German Patent Application No. 202010012495.6 filed on Sep. 13, 2010, the contents of all of which are incorporated herein by reference.

The invention relates to a comminution device comprising a first cutting element, including at least one first cutting edge, a second cutting element which is moveable on a first path of movement relative to the first cutting element and which has at least one second cutting edge, wherein the second cutting element lies against the first cutting element in such a way that the relative movement of the second cutting element along the first path of movement produces a shearing action between the at least one first cutting edge and the at least one second cutting edge, and an adjusting mechanism which adjusts the second cutting element relative to the first cutting element on a second path of movement in such a way that the second cutting element is moved closer for permanent contact with the first cutting element when the first and/or second cutting element wears down as a result of the relative movement along the first path of movement.

Cutting devices of this design are used to shred, comminute or macerate solids, solid matter, or solid-containing liquids and are specifically used as "wet macerators", for example in the food industry, in the preparation of biosuspensions for further energy extraction or to prepare free-flowing mixtures with solids for other agricultural purposes, and in the process to comminute the solids contained therein.

A cutting device of the kind initially specified is known from PCT/EP2010/053800, which is also published as DE 20 2009 003 995. In this prior art comminution device, the first and the second cutting elements are formed by a fixed, circular perforated disk and by a blade which rotates about the middle axis of the perforated disk and lies with a cutting edge against the surface of the perforated disk. The mass to be comminuted is pressed through the holes in the perforated disk, and solids passing through the holes are comminuted by shearing due to the shearing effect produced between the blade edge and an edge defining the respective hole. The disclosure of said document is incorporated in its entirety by reference into the disclosure of the present description.

One basic problem with macerators of this design is caused by wear of the two cutting elements, i.e. of the perforated disk and in particular of the blade in the case described by way of example therein. In order to ensure uniform cutting power at all times, or at least one that deteriorates only slightly, providing an adjusting mechanism designed to keep the two cutting elements in contact with each other at all times and if possible with a defined contact force is basically known from the prior art. For example an adjusting mechanism fulfilling this purpose, comprising a biased, free-rolling ball, is known from the aforementioned prior art. In addition to this technical solution, however, other fully-functioning adjusting mechanisms are known, for example adjusting mechanisms which press and reposition a cutting blade against a perforated disk by means of a hydraulically transmitted tensioning force, or adjusting mechanisms which produce such a readjusted tensioning force between two cutting elements by means of a pretensioned worm gear.

The main requirement to be met by such adjusting mechanisms is reliable adjusting motion, on the one hand, while also ensuring that parting of the two cutting elements from each other is prevented when a harder solid is being cut, thus causing a substantial force which forces the two cutting elements apart. In the prior art, suitable blocking mechanisms are integrated for this purpose in such adjustment mechanisms to prevent the two cutting elements from moving temporarily or permanently from a pre-adjusted position into a spaced-apart position. This is achieved in the aforementioned prior art, for example, by the blocking action of a freewheeling ball, but can also be achieved in other configurations by means of nonreturn valves in hydraulic lines, or the like.

However, one disadvantage of the prior art and also of the design developed in the aforementioned utility model application is that it is not easy for a user to determine the wear condition of at least one or of both of the cutting elements. This would generally require that the comminution device be dismantled and freed of any residues of the solids-laden liquid, that the cutting elements be subjected to visual inspection and metrological inspection, to detect any excessive wear condition that may be developing and to detect any resultant failure of the comminution device before such a condition arises.

The object of the invention, according to a first aspect thereof, is therefore to provide a comminution device which provides a simple way of determining the wear condition.

This object is achieved, according to the invention, when the adjusting mechanism has a leak-free hydraulic cylinder which is coupled mechanically and functionally between the first and the second cutting element, in order to bring about an adjusting movement between the first and the second cutting element by actuating the hydraulic cylinder and to cause the first and second cutting elements to contact each other by application of pressure to the hydraulic cylinder, and when the hydraulic cylinder is in hydraulic communication with a closed hydraulic and pneumatic volume which includes a pressure vessel, the volume of which is filled with a hydraulic fluid in a first part and with air in a second part, and the wall of which is at least partially transparent so that the hydraulic fluid level can be read from a scale which defines the boundary region ensuing during operation between an air volume fraction and a hydraulic fluid volume fraction in the closed hydraulic and pneumatic volume and displays a wear condition of the first and second cutting element.

According to the first aspect of the invention, a specific kind of adjusting mechanism is provided, which is designed in such a way that there is a convenient way of reading the wear condition of the two cutting elements. The invention exploits in a special way the fact that hydraulic adjustment achieves an almost constant biasing force over the entire path of adjustment whenever pressure is applied to it via an air cushion in the hydraulic system, provided the ratio between the volume of the air cushion and the hydraulic volume moved by the adjusting motion is sufficiently large, while also providing a way of reading off the amount of adjustment from the level of hydraulic fluid. This capability to read off the amount of adjustment is embodied by a leak-free hydraulic cylinder, in particular by a leak-free hydraulic system of such a kind that the wear condition can be read from the level of the hydraulic fluid throughout the entire duration that the cutting elements are used.

According to the invention, a leak-free hydraulic cylinder or a leak-free hydraulic system is understood to be a hydraulic cylinder or hydraulic system which uses only hydraulic components that fully prevent the escape of hydraulic fluid from the pressure side. According to that understanding, and in the context of the invention, hydraulic systems are considered to be non-leakage free if they are designed in such a way that hydraulic fluid can escape from the pressure system, for example due to partly desirable leakage in a hydraulic actuator, with the hydraulic fluid then being collected in a sump and returned to the hydraulic pressure system by means of a hydraulic pump. It is crucially important for the inventive function that the total volume of hydraulic fluid moved on the pressurised side of the hydraulic system does not change throughout the entire duration that the comminution device is in use.

As a basic principle, "application of pressure" or the "pressure" should be understood within the meaning of this description and the appended claims to mean an overpressure or an underpressure relative to the ambient pressure. In this sense, the adjusting mechanism may be effected by applying an overpressure or a vacuum to the hydraulic cylinder.

A hydraulic cylinder within the meaning of this description and the claims is understood to be a hydraulic actuator of any construction that converts a hydraulic pressure into a mechanical force and movement. This can be done using a linear cylinder or a rotary cylinder actuator, for example. According to the invention, the hydraulic cylinder is coupled mechanically and functionally between the first and the second cutting element. This functional coupling of the hydraulic cylinder between the first and the second cutting element is not be understood as an actual spatial arrangement of the hydraulic cylinder between the first and second cutting elements. Instead, it should be understood to mean that the hydraulic cylinder is mechanically coupled in such a way to the two cutting elements, either directly or via force-transmitting elements such as levers, pressure rods or pull rods or the like, that the movement and/or force generated in the hydraulic cylinder produces a relative movement and relative exertion of force by the one cutting element in relation to the other cutting element. This results in a defined compressive force being exerted by the two cutting elements on one another and simultaneously produces an adjusting movement when the two cutting elements are subjected to wear. This functional coupling of the hydraulic cylinder can basically be achieved, for example, by mounting the one cutting element fixedly in a housing or casing to which the cylinder part of the hydraulic cylinder is likewise fixedly coupled, and arranging the other cutting element inside the casing such that it can be moved relative to said first cutting element, and by coupling the piston of the hydraulic cylinder to said second cutting element via a pull rod or the like. In other variants, a hydraulic actuator may be fixedly coupled with its cylinder casing to a housing or casing and to a first cutting element mounted thereon, the rotational movement of the hydraulic cylinder being transmitted via a worm gear to a pull rod which acts on a second cutting element and moves the latter inside the housing relative to the first cutting element.

A closed hydraulic and pneumatic volume is understood to be a system which is sealed against the surroundings and is composed of one or more pressure vessels and the hydraulic cylinder, as well as hydraulic lines, compressed air lines, valves and the like which connect said components. According to the invention, such a closed hydraulic and pneumatic volume is provided with a pressure vessel having an at least partially transparent wall. In one variant of the invention, said volume may be a glass cylinder or glass beaker in which, when the comminution device according to the invention is properly installed, the boundary between the hydraulic fluid and the air runs inside the closed hydraulic and pneumatic volume, namely at any position of the two cutting elements that move as a result of wear. In other variants, this level can be read through a transparent strip extending in the wall transversely to the level and as part of the wall. In the region of this hydraulic fluid level, a scale is provided which directly assigns the hydraulic fluid level to a wear condition, for example by showing a percentage scale from 100 to 0%, or by entering the adjusting movement on a scale in a unit of length, for example in mm.

The solution according to the invention provides a simple yet reliable adjusting movement and compressive force between two cutting elements that are subject to wear, and permits the wear condition to be read off in a simple manner. The invention avoids having to dismantling or partially dismantle the comminution device in order to detect the wear condition. The invention also avoids having to provide additional components for the purpose of displaying the wear condition, such as sensors detecting the wear by scanning a path, or sensors and the like which detect wear by measuring weight at one or both cutting elements, with concomitant signal processing and signal displaying.

According to a first preferred embodiment, the closed hydraulic and pneumatic volume is connected via a compressed air line having a nonreturn valve to an air pump or to a compressed air inlet for pressurising the pressure vessel with compressed air, the nonreturn valve acting in such a way that it prevents a volumetric flow from the pressure vessel to the air pump and/or the compressed air inlet.

This development of the invention allows the contents of the closed volume to be pressurised with compressed air, thus preventing air from escaping from or entering the volume undesiredly. The compressed air line is preferably connected to a section of the closed volume in which there is no hydraulic fluid.

According to another preferred embodiment, the hydraulic cylinder is adjustable between a first position, in which both cutting elements lie against each other when in an unworn, new condition, and a second position, in which both cutting elements lie against each other in a worn, used condition requiring replacement, said cylinder changing its volume hydraulically between the two positions, and in that these changes in volume amount to at most 20%, preferably at most 10% of the air volume fraction in the closed hydraulic and pneumatic volume.

With this configuration, the volume expansion resulting from adjusting motion from the totally unworn state to the totally worn state of the cutting elements is in such a ratio to the air volume fraction in the closed hydraulic and pneumatic volume that the expansion of this air volume fraction does not cause any significant reduction in the biasing force with which the two cutting elements are pressed against one another. It should be understood in this regard that the air volume fraction is calculated as the total volume of air in the closed volume, and that the change in hydraulic volume is usually calculated by multiplying the hydraulically effective cross-sectional area of the hydraulic cylinder by the path of travel of the hydraulic cylinder between the first, unworn position and the second, worn position.

As an alternative to this solution, the closed hydraulic and pneumatic volume can be subdivided into one volume filled with air and one volume filled with air and hydraulic fluid, with these two volumes being connected to each other via an adjustable pressure-reducing valve. In this way, a constant pressure can be maintained in the hydraulic fluid over the entire adjustment path as long as the pressure in the air-filled volume is greater than the pressure in the volume filled with air and hydraulic fluid, and can be reduced accordingly to a constant level.

It is still further preferred that the hydraulic cylinder is adjustable between a first position, in which both cutting elements lie against each other when in an unworn, new condition, and a second position, in which both cutting elements lie against each other in a worn, used condition requiring replacement, said cylinder changing its volume hydraulically between the two positions, and that the pressure vessel includes, in the region of the scale, a cross-sectional area along the hydraulic fluid level, which is at most so large that the relationship between the change in hydraulic volume of the hydraulic cylinder and the cross-sectional area is greater than 1 cm and preferably greater than 2 cm. With this preferred embodiment, the change in hydraulic fluid level that arises in the course of an adjusting movement is such that sufficient resolution is achieved when reading off the wear condition. It should be understood that the design parameters in this regard include the hydraulically effective cross-sectional area of the hydraulic cylinder as one variable, and in particular its ratio to the cross-sectional area of the fluid level, meaning the surface area of the hydraulic fluid at the boundary to the air volume. Movement of the hydraulic cylinder can also be converted by lever transmission into the adjusting movement of the two cutting elements relative to each other, for example when the cylinder movement is reduced such that a path of travel of the cylinder causes an adjustment of the two cutting elements that is smaller than the path of travel, or when the cylinder movement is magnified, i.e. such that a small path of travel produces a larger adjustment. In order to achieve sufficient accuracy of readings, a cross-sectional area must be provided that is as small as possible, although it should be understood here that, if the overall construction of the invention device is to be sufficiently compact, this approach to optimisation will be limited inter alia by the overall dimensions of the device.

It is still further preferred that the hydraulic cylinder acts on a transmission rod which transfers an adjusting force to a second rotating cutting element and which is guided inside a hollow shaft which transfers a rotary motion from a drive motor to the second cutting element, and that a first cutting element is formed by a cutting screen having a plurality of openings whose boundary edges form cutting edges along which the second cutting element is rotatingly moved in such a way that a shearing action is produced between the first cutting element and the cutting edges of the second cutting element. This embodiment achieves particularly efficient comminution, while also transferring the cutting forces and adjusting forces in a manner that is also beneficial for this kind of movement of the two cutting elements relative to each other, in particular robust transfer that is advantageous from the production engineering perspective.

It is also preferred that the pressure vessel and the air pump are integrally formed on a pressure unit, that the air pump includes a piston which is connected via a piston rod to a handle for manual operation, and further includes a cylinder which sealingly accommodates the piston and which is preferably attached pivotably to the pressure unit. This development of the invention results in a compact and integral construction of the entire adjusting mechanism that allows it to be produced particularly reliably with a leak-free design. The integral embodiment of an air pump on the pressure unit allows the comminution device according to the invention to be largely self-sufficient. This is made possible, in particular, by the fact that after pressurisation, operation of the comminution device is assured not only with regard to the required biasing force exerted on the two cutting elements but also with regard to their adjusting movement relative to each other, without an external supply of compressed air still being required.

It is further preferred that the pressure vessel includes a first pressure vessel having a first portion for hydraulic fluid and a second portion for air, the wall of said first pressure vessel being at least partially transparent in order to indicate the level of the hydraulic fluid and being provided with a scale for reading off the wear condition, and that the pressure vessel also includes a compressed air vessel which is connected via a compressed air line to the air portion of the first container, and that the compressed air vessel is in communication with the air pump and/or the compressed air connection.

This embodiment subdivides the closed volume into two vessels, the first vessel containing both hydraulic fluid and a volume of air, said container thus having the fluid level required for reading off, and a respective scale for that purpose. This first vessel can preferably be defined by a glass tube or a glass beaker to allow the scale to be read easily. According to this embodiment, a second compressed air vessel containing compressed air only is also provided. This variant moves the large air volume, which is required for exerting a constant biasing force over the entire range of adjustment, out of the vessel with the fluid level to a compressed air vessel, thus allowing the vessel containing the fluid level to have a fluid level with a cross-sectional surface area that is optimised for high-resolution readability, i.e. a small cross-sectional area that allows a relatively large change in fluid level over the entire adjustment range of the two cutting elements. The preferably large volume of air is then provided via a second vessel, namely the compressed air vessel, which may have a suitably large cross-section for providing the aforementioned, preferably large ratios between the air volume and the volume in the entire closed system, which is changed by the adjusting movement. This embodiment is specifically preferred when the first pressure vessel and the compressed air vessel are connected to each via an adjustable pressure-reducing valve, in which case the compressed air vessel acts as a supply of pressure for said pressure-reducing valve.

According to another preferred embodiment, the compressed air vessel is in communication with a first pressure vessel, containing hydraulic fluid and a volume of air, via an adjustable pressure-reducing valve, which can be adjusted between at least one, preferably at least two of the following valve positions: a first position, in which the compressed air vessel and the first pressure vessel are connected to each other and isolated from the ambient pressure, a second position, in which the compressed air vessel is connected to the ambient pressure and the first pressure vessel is isolated from the ambient pressure and the compressed air vessel, a third position, in which the first pressure vessel is connected to the ambient pressure and the compressed air vessel is isolated from the ambient pressure and the compressed air vessel, a fourth position, in which the first pressure vessel and the compressed air vessel are connected to the ambient pressure, and/or a fifth position, in which the first pressure vessel is isolated from the compressed air vessel and the first pressure vessel and the compressed air vessel are isolated from the ambient pressure, wherein the multiport valve preferably acts in the first, second, third and/or fourth position as an adjustable pressure-reducing valve. This adjustable pressure-reducing valve thus allows the first pressure vessel to be connected to the ambient pressure while maintaining the pressure in the compressed air vessel, thus permitting the cutting elements to be moved relative to one another without the hydraulic cylinder having to be mechanically released from its coupling with said two cutting elements, and thus allowing one or both of the cutting elements to be conveniently replaced. After such replacement, the first pressure vessel can be pressurised from the compressed air vessel by setting the pressure-reducing valve to the transverse position. It is also possible with the pressure-reducing valve to reduce the pressure in the entire system by connecting it to the ambient pressure, thus adjusting the compressive force between the two cutting elements. As a result of the pressure-reducing action of the pressure-reducing valve, a constant pressure is maintained in the first pressure vessel when the volume expands, as long as the pressure in the compressed air vessel is greater than the pressure in the first pressure vessel. Variation that can arise in the hydraulic and pneumatic volume can also be prevented or at least reduced in this manner.

It is still further preferred that a positive engagement connection is formed between the second cutting element and a hollow shaft for transferring the cutting force along the first path of movement, said positive engagement connection being formed by positive engagement in a circumferential direction in order to transfer the driving force required for the first path of movement, and being movable in an axial direction in order to perform an adjusting movement along the second path of movement. This configuration is a particularly advantageous form, with regard to design and production engineering, for hydraulic transmission of an adjusting force, and one in which continuous and reliable adjusting movement of a rotating blade can be achieved.

It is further preferred that a lubricant-filled cavity is formed between a first area coupled to the first cutting element or to a component coupled to the first cutting element and a second area coupled to the second cutting element or to a component coupled to the second cutting element, the volume of said cavity being reduced by an adjusting movement of the second cutting element along the second path of movement and said cavity being in fluidic communication with the positive engagement connection in order to supply lubricant to the positive engagement connection (see also the description of the second aspect of the invention). This development is based firstly on the realisation that the decline in cutting efficiency over a longer period of operation involving the stresses and strains of comminution is caused by the fact that the positive engagement connection for transmitting the cutting movement between the first and second cutting elements, in other words the relative movement along the first path of movement, no longer reliably allows the adjusting movement along the second path of movement, due to the aforementioned stresses and strains involved in comminution. One reason for this is that setting phenomena occur in said positive engagement connection due to cyclical stresses and strains, while the combination of this kind of stress and strain with what are often aggressive media that cannot always be reliably prevented from entering the positive engagement connection results in an adhesive effect, combined with adhesive forces caused by corrosion or contamination, as a result of which a clamping force may arise that counteracts motion along the second path of movement. This results in the desired adjusting motion of the two cutting elements to compensate for wear not being uniformly achieved, but irregularly or in some cases not at all, thus resulting at least temporarily and in some cases permanently in a gap occurring between the first and the second cutting element that reduces the cutting quality and capacity, i.e. the first cutting element no longer lies or no longer lies fully on the first cutting element.

This problem is solved, in this development of the invention, by lubrication of the positive engagement connection. The invention specifies that this lubrication is achieved in a simple and reliable manner by providing a cavity in the region of the adjusting mechanism, from which cavity a lubricant can be conveyed into the region of the surfaces which are moved relative to each for the adjusting movement along the second path of movement. According to the invention, the lubricant is conveyed out of this cavity by limiting such a cavity with walls that are connected to the components that are moved towards each other by the adjusting movement, thus reducing the volume of the cavity when an adjusting movement is performed. By means of this configuration, a lubricant in the cavity is conveyed in small portions, at each adjusting movement and resultant reduction in cavity volume, between the parts of the positive engagement connection that are moved relative to each other, thus achieving continuous lubrication of the positive engagement connection with small doses. This lubrication is achieved without an additional lubricant pump or the like, and without a separate drive unit. Lubrication is provided in doses form as a result of the adjusting movement that is being lubricated. The cavity can be dimensioned in such a way that a supply of lubricant into the positive engagement connection is assured over a long period, and it is possible to allow the cavity to be externally replenished with lubricant. This may be necessary, for example, when one or both of the two cutting elements must be replaced due to severe wear, and the adjusting mechanism is returned to an initial position, as a result of which the cavity is enlarged to its initial size and must then be filled with lubricant.

It is particularly preferred in this regard that the lubricant-filled cavity is connected to a lubrication nipple for feeding lubricant into the cavity. This configuration allows the cavity to be filled with new lubricant at regular servicing intervals, and it should be understood as a basic principle thereby that the cavity can always be filled with such an amount of lubricant that it ensures lubrication of the positive engagement connection over the entire period for readjusting the operation of a cutting element pair, i.e. from the installation of new cutting elements to replacement of those cutting elements due to wear, in order to fill the cavity with new lubricant when the adjusting mechanism is returned to an initial position and one or both cutting elements are replaced. According to the invention, any hydrocarbon based grease and in particular any oil based grease can basically be used as the lubricant, although other lubricants, for example lubricants containing silicone or graphite, or soap-based lubricants or liquid lubricants such as petroleum lubricant oils or synthetic oils can be used.

It is still further preferred that the second path of movement lies perpendicular to the first path of movement. This configuration of the two paths of movement results in efficient adjusting movement to compensate for the wear which is caused by movement along the first path of movement.

According to another preferred embodiment, the first cutting element is a perforated disk, and a plurality of first cutting edges are formed by openings in walls defining the perforated disk, and the second cutting element includes a blade which rotates on the surface of the perforated disk along the first path of movement. The perforated disk may be circular in shape and have a plurality of openings, such as bores, triangular or trapezoidally shaped recesses or through holes with other cross-sections. On the one hand, this design allows media to be conducted efficiently, in that the solids to be cut are made to flow through the openings in the first cutting element. On the other hand, efficient cutting action distributed over many cutting edges on the first cutting element is achieved, in that a plurality of first cutting edges on the first cutting element are formed by the boundary edges of the openings and in that, with this plurality of first cutting edges, one or more cutting edges are produced in the form of the blades rotating on the first cutting element.

According to another preferred embodiment, finally, the second cutting element includes a blade which rotates on the surface of the first cutting element along the first path of movement, and the positive engagement connection is formed between a blade holder which accommodates the blade and a drive shaft which drives the blade, in particular as a positively interlocking shaft-hub connection between a shaft which drives the second cutting element and a hub body which holds the second cutting element, in particular a splined shaft connection or a tongue and groove connection. In this embodiment, the drive member is formed by a drive shaft, which can be driven by an electric motor, for example, and which causes the blade to rotate on the first cutting element. It should be understood here, as a basic principle, that the second cutting element may also be formed by a plurality of two, three or four blades, for example, that are spaced apart from each other by a circumferential angle and which are collectively driven. The drive shaft itself may be provided so that it is axially displaced for an axial adjusting movement of the second cutting element, or some other element produces this axial movement for the adjusting movement, for example a pull rod or pressure rod which is guided in a drive shaft embodied as a hollow shaft.

It is preferable that the comminution device according to the first aspect of the invention also has the features of a comminution device according to at least one preferred embodiment of a second aspect of the invention (discussed further below). All the observations regarding the preferred configuration of the invention according to the preferred embodiments of the second aspect, discussed below, also apply to the respective embodiments according to the first aspect of the invention.

According to a second aspect, the invention relates to a comminution device of the kind initially specified, wherein a positive engagement connection is formed, in particular, between the second cutting element and a transmission element for transmitting the cutting force along the first path of movement, said positive engagement connection being formed by positive engagement in a first axial direction in order to transmit the driving force required for the first path of movement and being movable in a second axial direction in order to perform an adjusting movement along the second path of movement.

A basic challenge in this regard is that the adjusting mechanism has to mechanically couple the movement between the two cutting elements required for the cutting effect, and in the process must ensure a high level of force or torque transmission and fast relative motion, yet must also perform the adjusting movement in a reliable manner and with very small adjusting movements, which is different in orientation from said cutting movement and involves a small adjusting force in most kinds of adjusting mechanism.

It has been found that reliable adjustment and cutting action can be achieved in most cases with the prior art. However, there is a need for improvement in that, in certain applications, and especially when solids-laden liquids must be comminuted over a longer period, with the cutting elements being exposed to considerable stresses and strains, sufficient cutting action is no longer achieved with the desired quality when the comminution device has been operating for a longer period, in particular when one or both of the two cutting elements had to be replaced several times due to wear.

According to a second aspect, the object of the invention is to provide a comminution device that also ensures a high level of comminution quality over a longer period of operation, without shorter maintenance intervals or more intensive maintenance having to be accepted.

According to the invention, this object is achieved with a comminution device with the previously described construction, in which a lubricant-filled cavity is formed between a first area coupled to the first cutting element or to a component coupled to the first cutting element and a second area coupled to the second cutting element or to a component coupled to the second cutting element, the volume of said cavity being reduced by an adjusting movement of the second cutting element along the second path of movement and said cavity being in fluidic communication with the positive engagement connection in order to supply lubricant to the positive engagement connection.

The invention is based firstly on the realisation that the decline in cutting efficiency over a longer period of operation involving the stresses and strains of comminution is caused by the fact that positive engagement connection for transmitting the cutting movement between the first and second cutting elements, in other words the relative movement along the first path of movement, no longer reliably allows the adjusting movement along the second path of movement, due to the aforementioned stresses and strains involved in comminution. One reason for this is that setting phenomena occur in said positive engagement connection due to cyclical stresses and strains, while the combination of this kind of stress and strain with what are often aggressive media that cannot always be reliably prevented from entering the positive engagement connection results in an adhesive effect, combined with adhesive forces caused by corrosion or contamination, as a result of which a clamping force may arise that counteracts motion along the second path of movement. This results in the desired adjusting motion of the two cutting elements to compensate for wear not being uniformly achieved, but irregularly or in some cases not at all, thus resulting at least temporarily and in some cases permanently in a gap occurring between the first and the second cutting element that reduces the cutting quality and capacity, i.e. the first cutting element no longer lies or no longer lies fully on the first cutting element.

This problem is solved according to the invention (as already explained above in connection with the first aspect) by lubrication of the positive engagement connection. The invention according to the second aspect specifies that this lubrication is achieved in a simple and reliable manner by providing a cavity in the region of the adjusting mechanism, from which cavity a lubricant can be conveyed into the region of the surfaces which are moved relative to each for the adjusting movement along the second path of movement. According to the invention, the lubricant is conveyed out of this cavity by limiting such a cavity with walls that are connected to the components that are moved towards each other by the adjusting movement, thus reducing the volume of the cavity when an adjusting movement is performed. As a result of this design, a lubricant in the cavity is conveyed in small portions, with every adjusting movement and with the resultant reduction in cavity volume, between the parts of the positive engagement connection moved relative to each other, thus effecting continuous lubrication of the positive engagement connection in small doses. This lubrication is achieved without an additional lubricant pump or the like, and without a separate drive unit. Lubrication is provided in doses form as a result of the adjusting movement that is being lubricated. The cavity can be dimensioned in such a way that a supply of lubricant into the positive engagement connection is assured over a long period, and it is possible to allow the cavity to be externally replenished with lubricant. This may be necessary, for example, when one or both of the two cutting elements must be replaced due to severe wear, and the adjusting mechanism is returned to an initial position, as a result of which the cavity is enlarged to its initial size and must then be filled with lubricant.

The first cutting element provided according to the invention may preferably be an element mounted detachably by immovably in the comminution device, in particular a perforated disk having a plurality of apertures whose boundary edges define the first cutting edges. The second cutting element may comprise one or more cutting blades that are moved on a path of cutting movement in contact with the first cutting element, in particular by rotating on a circular path about a rotational axis. The cutting edge of this cutting blade then forms the second cutting edge. In addition to this path of cutting movement, the cutting blade may also perform a second movement in a direction differing therefrom along the second path of movement, with which it is adjusted for permanent contact with the first cutting element. It should be understood, as a basic principle, that this adjusting movement could also be performed by moving the first cutting element.

More specifically, the adjusting mechanism can be actuated by a mechanical or hydraulic biasing force and preferably involves a lock which prevents the two cutting elements from leaving a position in which they abut each other. In one preferred embodiment of the invention, this adjusting mechanism is provided in the form of mobility within a positive engagement connection that is used simultaneously to transfer a movement to the first cutting element. It should be understood in this regard that the invention also includes configurations in which one of the two cutting elements is set in motion by a drive device in order to perform the cutting movement, and that the other one of the two cutting elements is held by positive engagement and is readjusted by the adjusting mechanism along a moveable axis of said positive engagement connection in order to compensate for wear. This means, on the one hand, that the cutting and adjusting movement can be performed by only one of the two cutting elements relative to another cutting element which otherwise remains fixed in the cutting device, although the cutting and adjusting movement can also be shared by two cutting elements, such that one of the two cutting elements is driven to perform the cutting movement and the other of the two cutting elements is driven to perform the adjusting movement. A crucial aspect in this regard is that a positive engagement connection is provided for the purpose of the adjusting movement between the adjusted cutting element and an element of the comminution device which is used to drive or to hold the adjusted cutting element, although a drive member which is moved relative to the comminution device or an element which holds the cutting element statically against this cutting movement is understood to achieve the same effect, according to the invention.

The direction of the first path of movement differs essentially from the direction of the second path of movement, in order to produce cutting action, on the one hand, and adjusting movement, on the other hand. It is particularly preferred that the first axial direction is the axis of a rotational movement for transferring a torque and that the first path of movement is a closed circular path. This produces a preferred form of movement for efficient operation, in which the first axial direction continuously changes and is always along the closed circular path. This embodiment allows the force for transferring the cutting movement performed along the first path of movement to be transmitted by a shaft-hub connection and reliable mechanical engineering elements to be used for the transmission of force.

It is further preferred that the second axial direction lies parallel to the second path of movement. This configuration makes it possible to perform the adjusting movement without need of deflection mechanisms, levers or the like, thus allowing direct transmission of force within the adjusting mechanism. More particularly, in conjunction with the aforementioned preferred embodiment with a circular first path of movement, it is possible for the second path of movement to run parallel to the axis of said circular path of movement.

It is basically advantageous as well if the first path of movement lies perpendicular to the second path of movement. This arrangement of the first path of movement to the second results in an efficient adjusting movement to compensate for the wear which is caused by movement along the first path of movement.

According to yet another preferred embodiment, the first cutting element is a perforated disk and are plurality of first cutting edges are formed by openings in walls defining the perforated disk, and the second cutting element includes a blade which rotates on the surface of the perforated disk along the first path of movement. The perforated disk may be circular in shape and have a plurality of openings, such as bores, triangular or trapezoidally shaped recesses or through holes with other cross-sections. On the one hand, this design allows media to be conducted efficiently, in that the solids to be cut are made to flow through the openings in the first cutting element. On the other hand, efficient cutting action distributed over many cutting edges on the first cutting element is achieved, in that a plurality of first cutting edges on the first cutting element are formed by the boundary edges of the openings and in that, with this plurality of first cutting edges, one or more cutting edges are produced in the form of the blades rotating on the first cutting element.

It is still further preferred that the second cutting element includes a blade which rotates on the surface of the first cutting element along the first path of movement, and that the positive engagement connection is formed between a blade holder which accommodates the blade and a drive shaft which drives the blade. In this embodiment, the drive member is formed by a drive shaft, which can be driven by an electric motor, for example, and which causes the blade to rotate on the first cutting element. It should be understood here, as a basic principle, that the second cutting element may also be formed by a plurality of two, three or four blades, for example, that are spaced apart from each other by a circumferential angle and which are collectively driven. The drive shaft itself may be provided so that it is axially displaced for an axial adjusting movement of the second cutting element, or some other element produces this axial movement for the adjusting movement, for example a pull rod or pressure rod which is guided in a drive shaft embodied as a hollow shaft.

According to another preferred embodiment, the second axial direction lies parallel to the rotational axis of the drive shaft. In this configuration, the adjusting movement is performed as an axial movement of the drive shaft itself, or of an element of the adjusting mechanism which runs along the drive shaft.

It is still further preferred that the lubricant-filled cavity is arranged between an axial end face of a drive shaft driving the first cutting element and connected by positive engagement to the first cutting element via the positive engagement connection, and an axial end face of a holder for the first cutting element, said holder being connected to said first cutting element and mounted moveably and axially displaceably along the second axial direction relative to the drive shaft in the positive engagement connection. In this configuration, a compact construction for transferring the cutting movement and the adjusting movement is achieved by means of a positive engagement connection, axially displaceable but with a fixed torque, between a drive shaft and a holder for the first cutting element, for example a blade holder, said construction forming the cavity according to the invention and feeding lubricant from said cavity into the lubrication slit formed in the positive engagement connection for the purpose of axial movement. It should be understood, as a basic principle, that both the axial end face of the holder and the axial end face of the drive shaft may be an end face in the form of a full circle, or a ring-shaped end face, or also just segments of such a full-circle or ring-shaped area. It should be understood here as a basic principle that the cavity is defined not only by these two end faces, but also by respective side walls that can be formed either on the holder or on the drive shaft, or by walls formed on both sides, on the drive shaft and on the holder, and extending circumferentially on both sides.

It is further preferred that the lubricant-filled cavity is connected to a lubrication nipple for feeding lubricant into the cavity. This configuration allows the cavity to be filled with new lubricant at regular servicing intervals, and it should be understood as a basic principle thereby that the cavity can always be filled with such an amount of lubricant that it ensures lubrication of the positive engagement connection over the entire period for readjusting the operation of a cutting element pair, i.e. from the installation of new cutting elements to replacement of those cutting elements due to wear, in order to fill the cavity with new lubricant when the adjusting mechanism is returned to an initial position and one or both cutting elements are replaced. According to the invention, any hydrocarbon based grease and in particular any oil based grease can basically be used as the lubricant, although other lubricants, for example lubricants containing silicone or graphite, or soap-based lubricants or liquid lubricants such as petroleum lubricant oils or synthetic oils can be used.

Finally, according to another preferred embodiment, the positive engagement connection is a positively interlocking shaft-hub connection between a shaft which drives the second cutting element and a hub body which holds the second cutting element, in particular a splined shaft connection or a tongue and groove connection. Such a positive engagement connection uses components that are well known and proven for reliable torque transmission and which, by means of the automated lubricant supply according to the invention, permit reliable displacement in the axial direction of the shaft, which can then be used to make adjustments by means of the adjusting mechanism.

The comminution device according to the second aspect of the invention works according to a method for adjusting the cutting elements of a comminution device, said method comprising the steps of:

transferring a cutting movement from a drive element onto one of the two cutting elements via a positive engagement connection, pressing the two cutting elements together in order to produce a shearing action in the course of the cutting movement between cutting edges formed on the cutting elements, readjusting the two cutting elements when the cutting elements wear down due to wear, in order to maintain the contact between the two cutting elements via a mobility provided in the positive engagement connection along an axis whose direction differs from the direction in which the force required for the cutting movement is transferred, providing a cavity which is defined by at least two surfaces moved towards each other in the course of the adjusting motion and which reduces its volume as a result when the two cutting elements are readjusted in relation to each other, and filling the cavity with a lubricant and connecting the cavity to a boundary surface between two surfaces which are moved relative to each other in the positive engagement connection in the course of the adjusting movement, in order to convey lubricant out of the cavity between these surfaces being moved relative to one other.

This method achieves efficient adjusting movement in such comminution devices by conveying lubricant in a targeted manner into the slit required for this purpose between two moved elements.

It is preferable that the comminution device according to the second aspect of the invention also has the features of a comminution device according to at least one preferred embodiment of the first aspect of the invention (discussed further above). All the observations regarding the preferred configuration of the invention according to the preferred embodiments of the first aspect, discussed above, also apply to the respective embodiments according to the second aspect of the invention.

Figure 3:
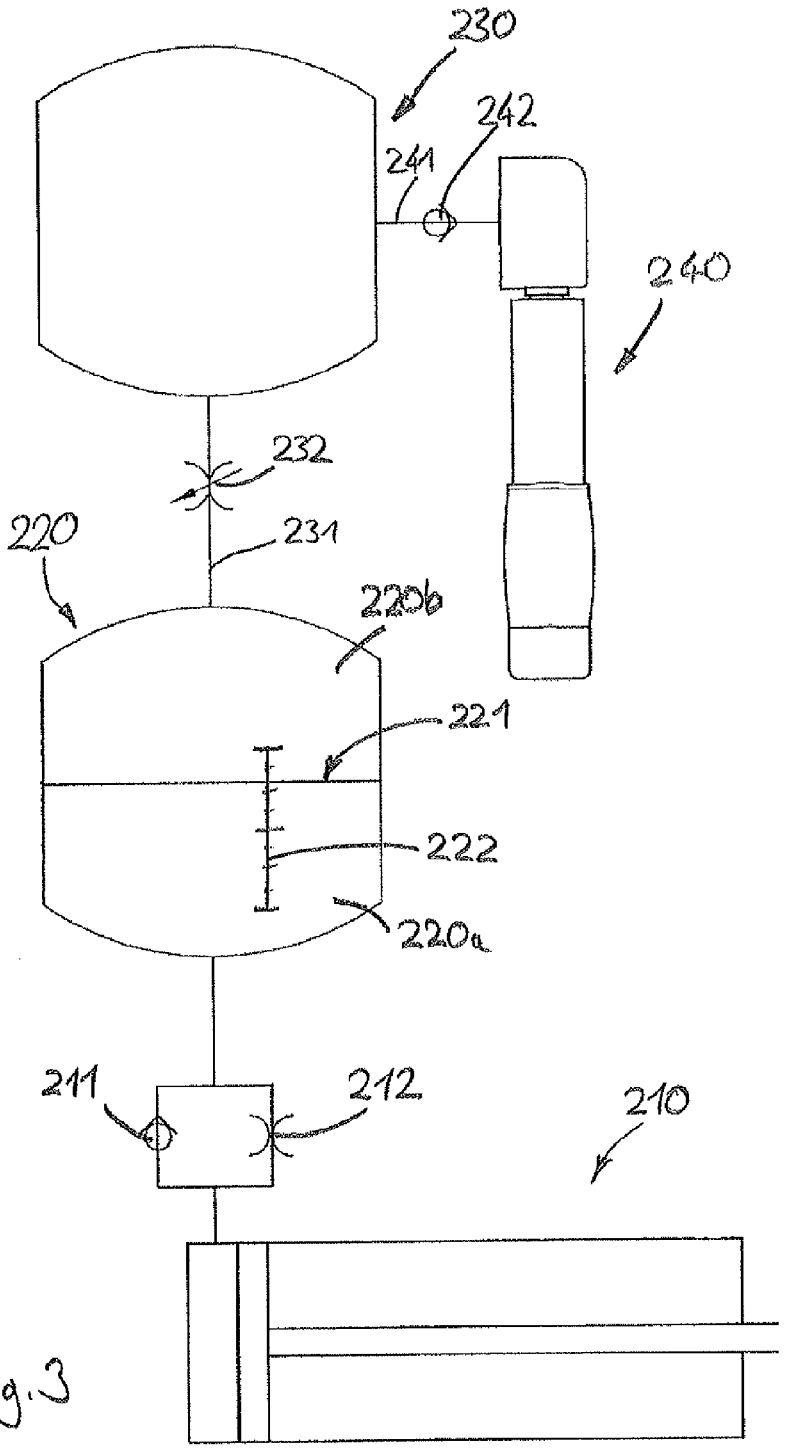
Figure 4:
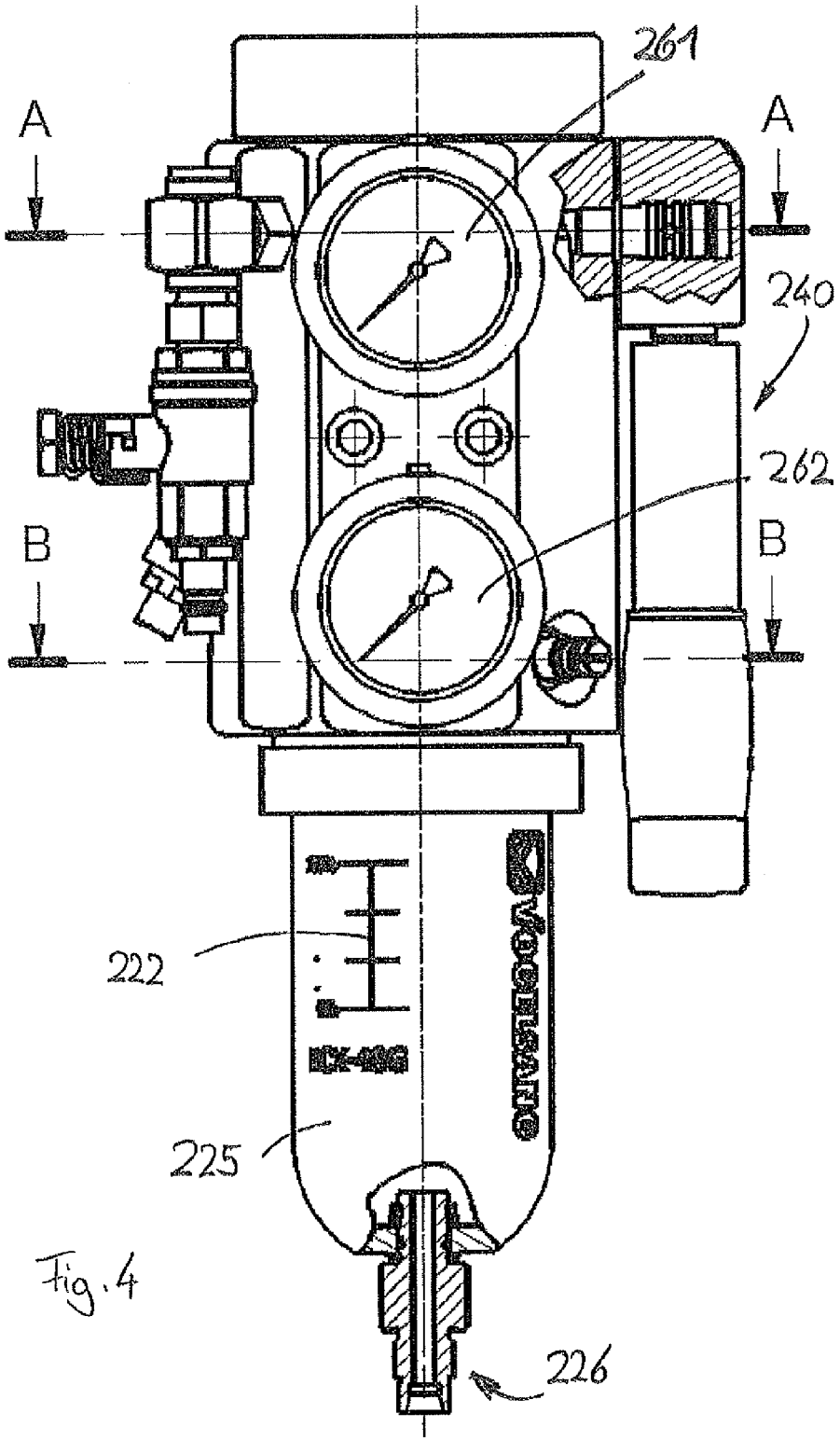
Figure 5:
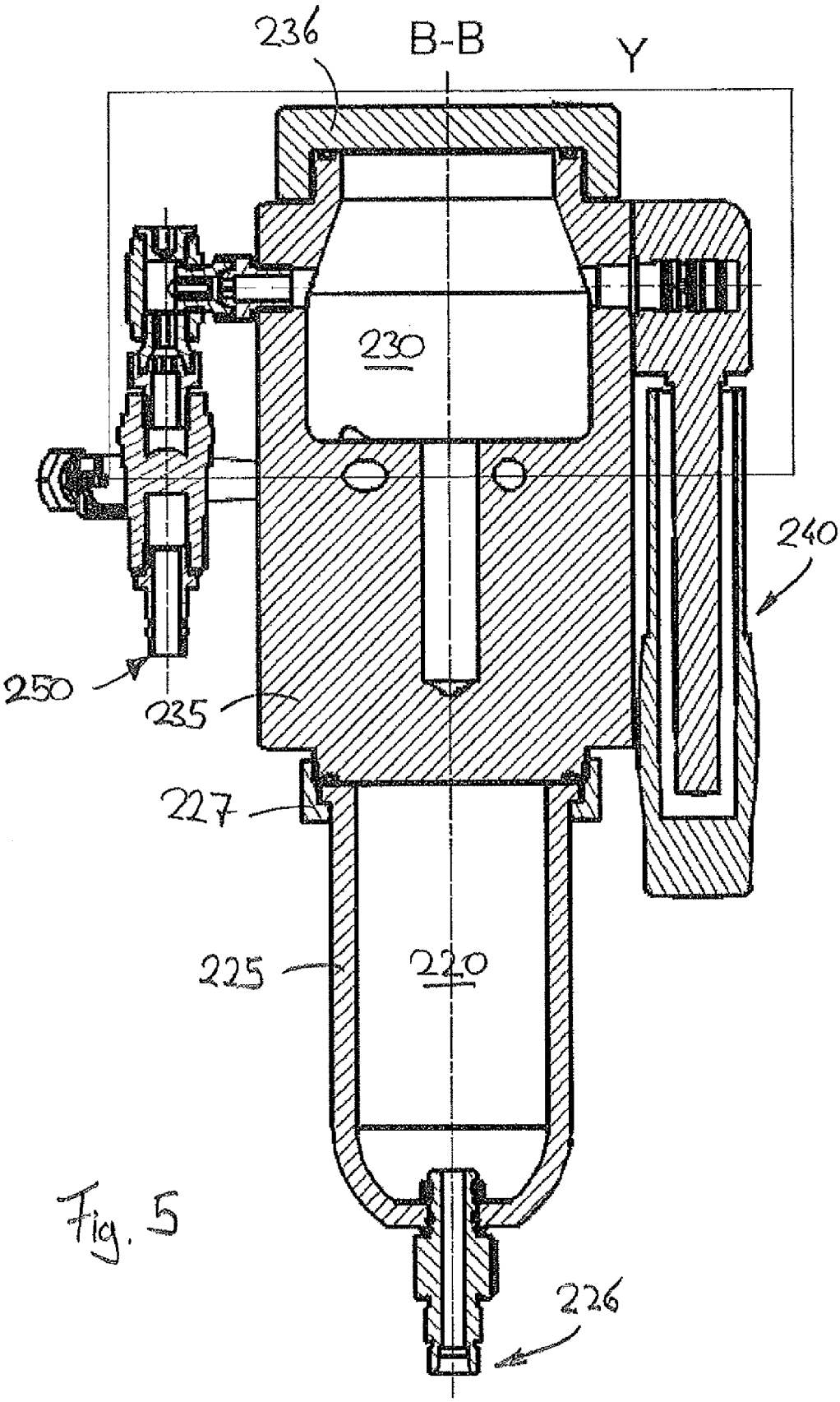
Figure 6:
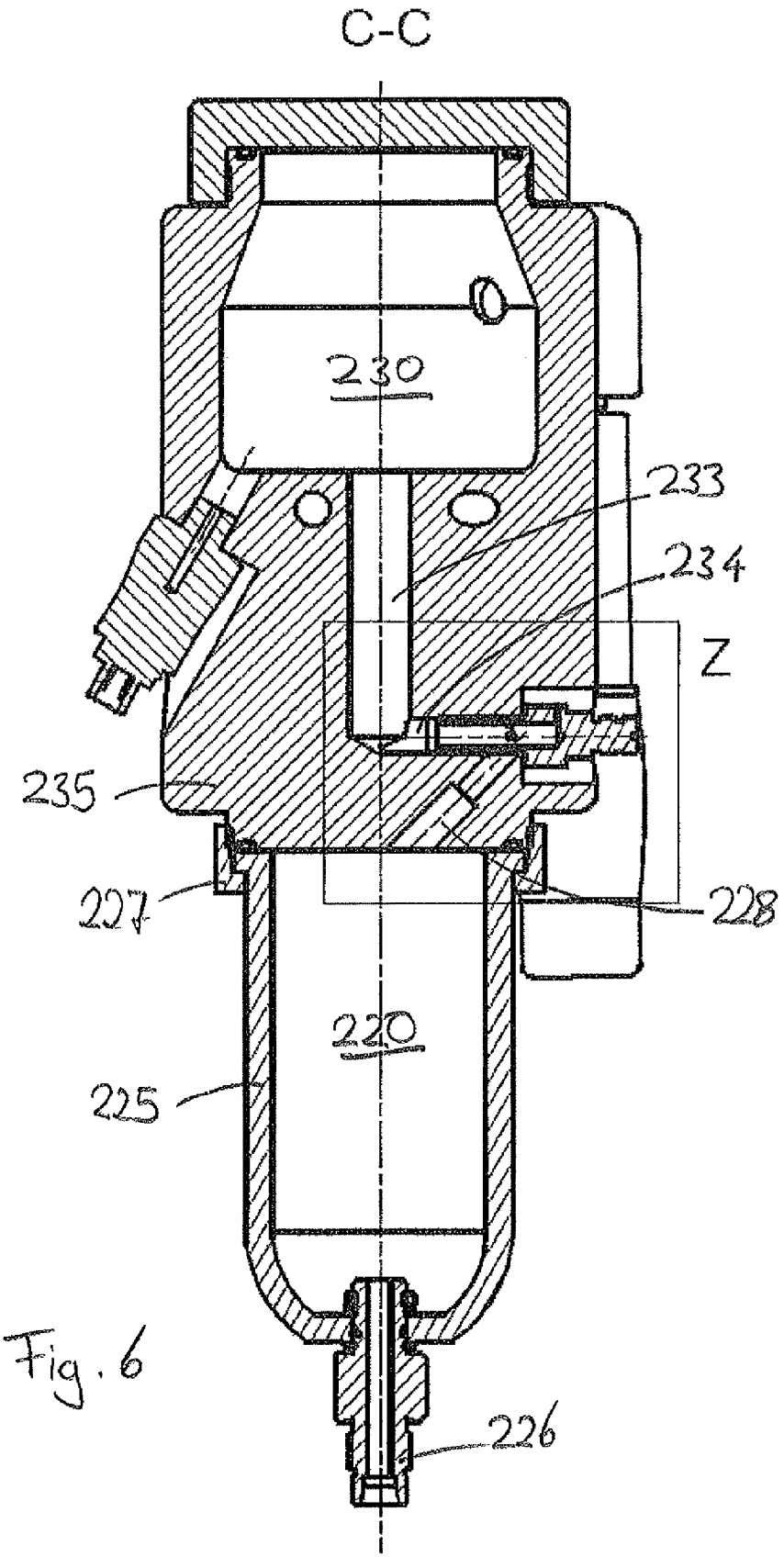
Figure 7:
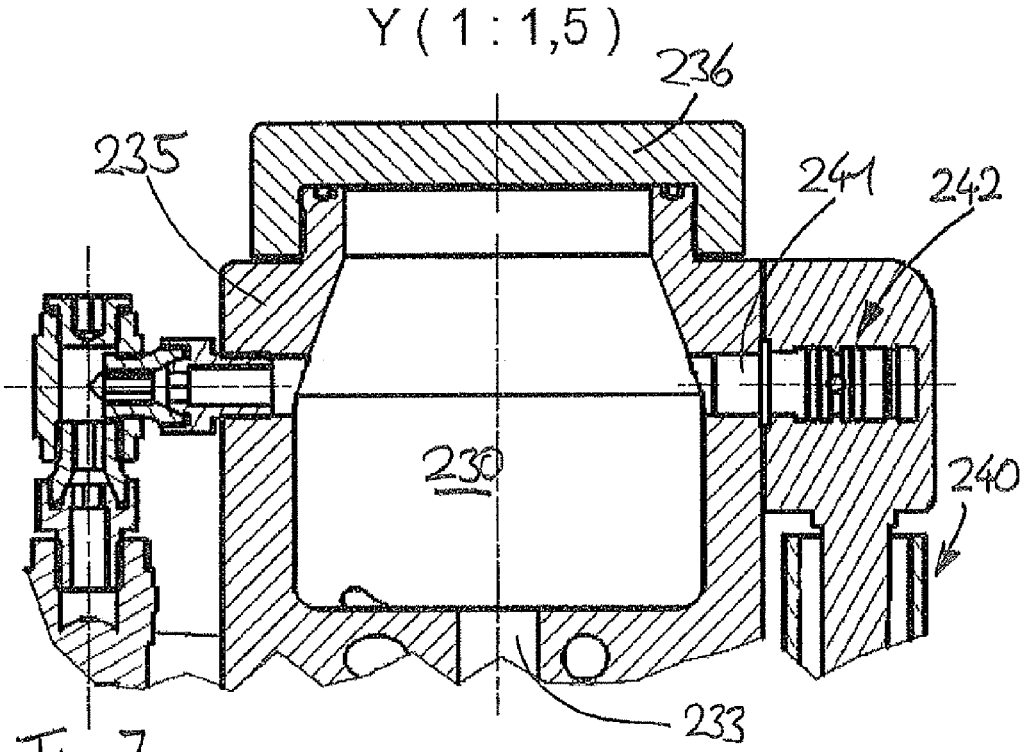
Figure 8:
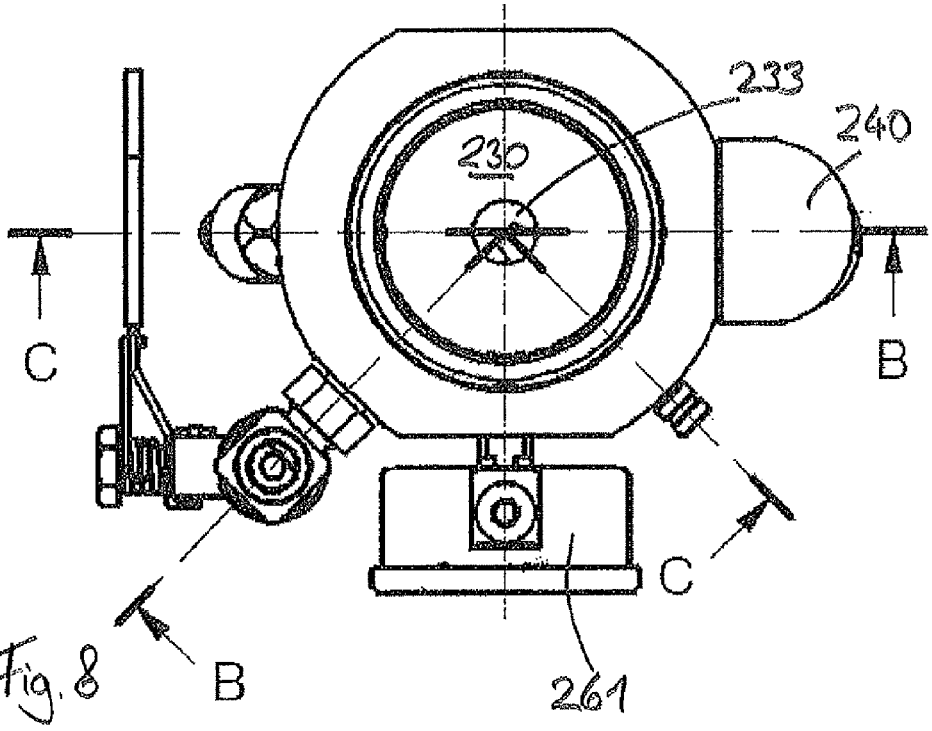
Figure 9:
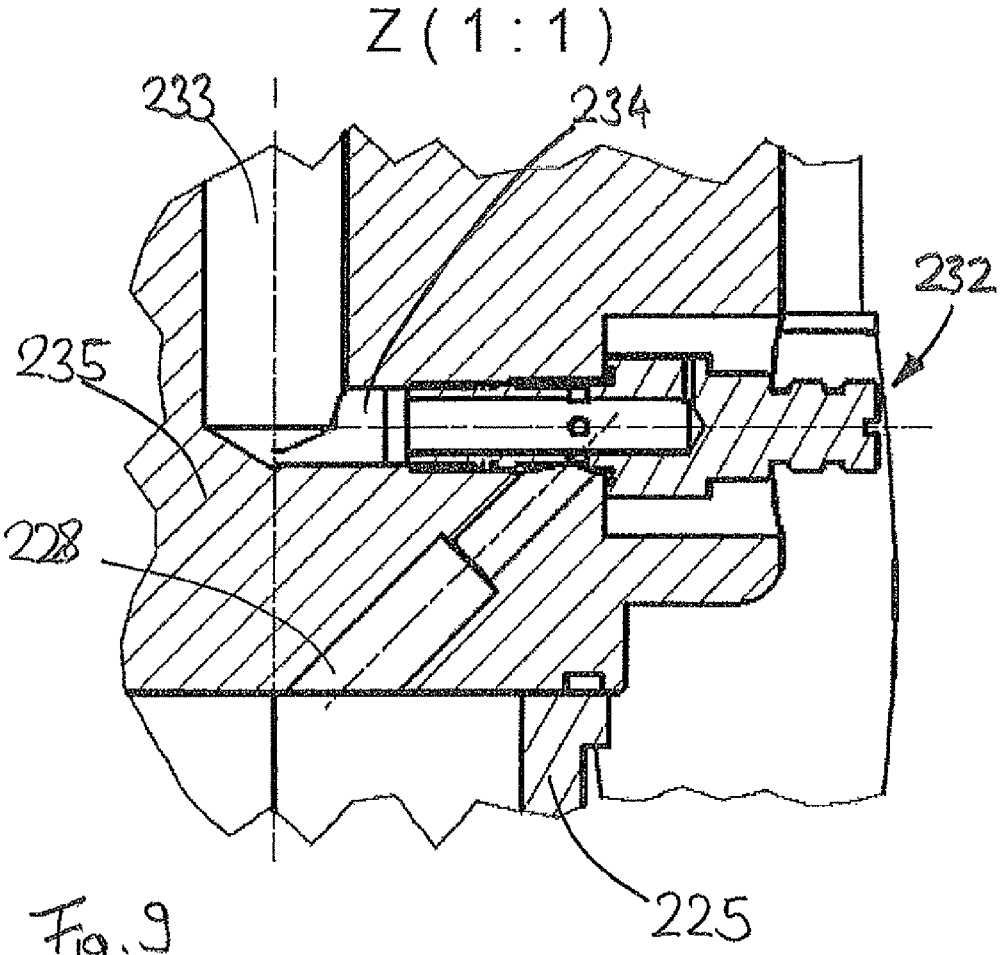
Figure 10:
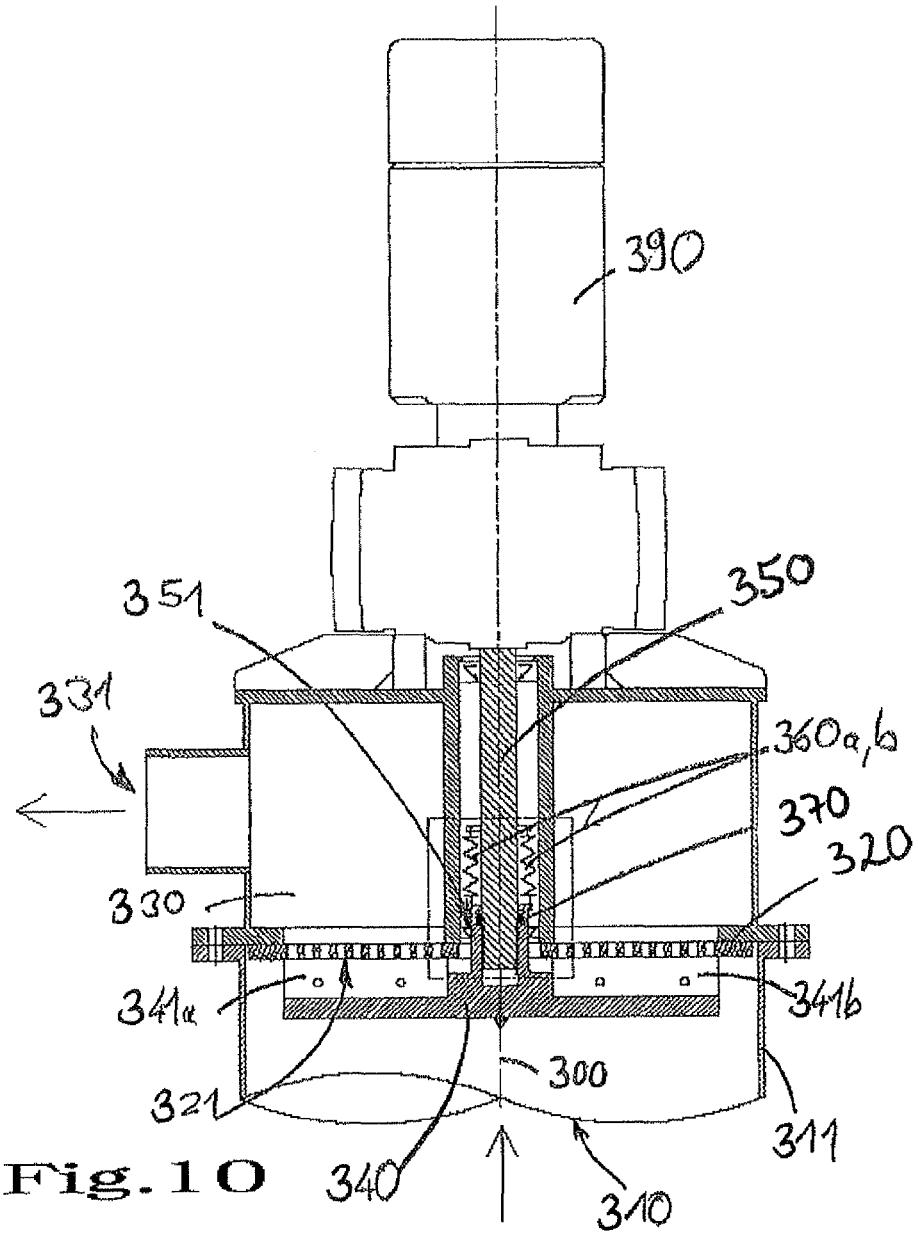
Figure 11:
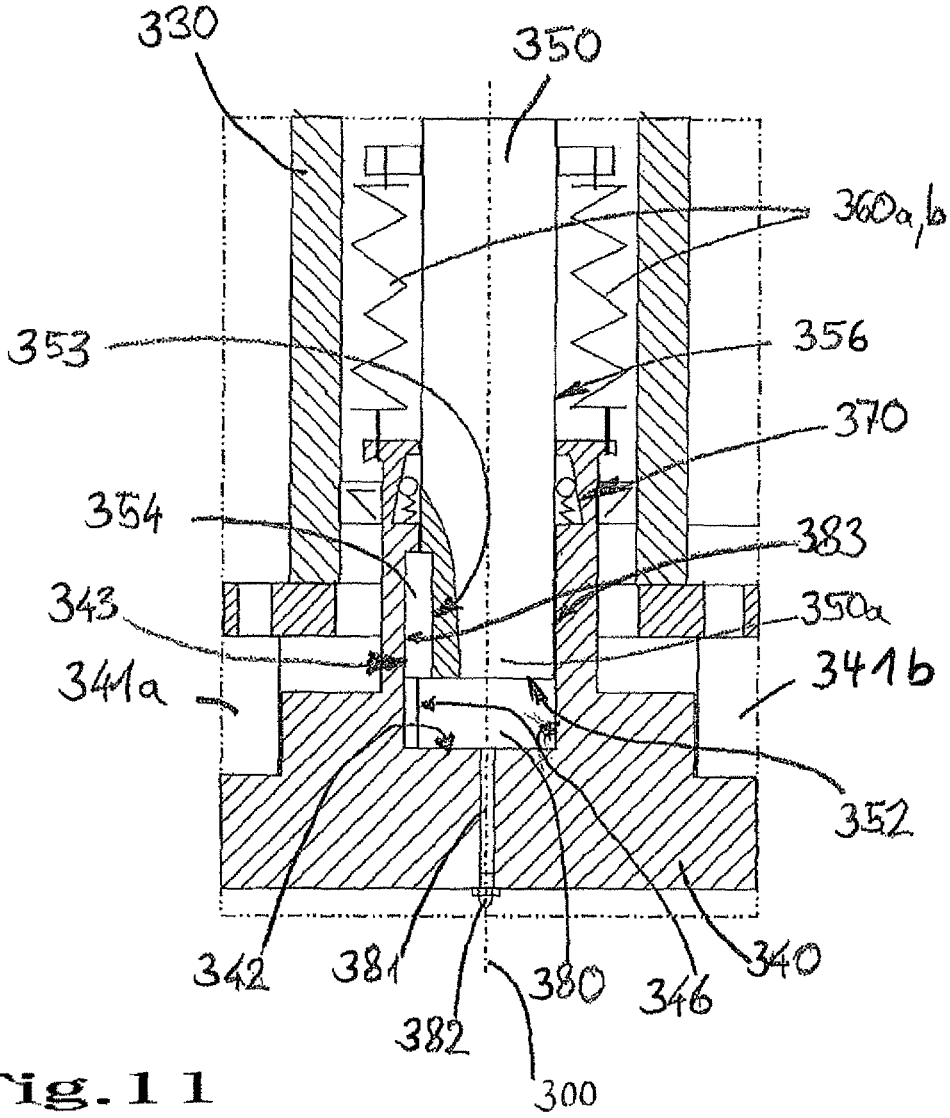

Preferred embodiments of the invention according to the first and second aspects shall now be described in more detail with reference to preferred embodiments and with reference to the attached Figures, in which:

FIG. 1 shows a longitudinal cross-sectional side view of an inventive comminution device according to the first aspect, without a hydraulically actuated adjusting mechanism, FIG. 2 shows a perspective view of the comminution device according to FIG. 1, FIG. 3 shows a schematic view of the hydraulic adjusting mechanism in the preferred embodiment according to FIGS. 1 and 2, FIG. 4 shows a front view of a hydraulic unit of the preferred embodiment according to the first aspect of the invention, in a partly cutaway view, FIG. 5 shows a cross-sectional view, along the line B-B in FIG. 7, of the embodiment according to FIG. 3, in a cutaway view along the entire length, FIG. 6 shows a longitudinal cross-sectional side view of the hydraulic unit according to FIG. 3, along the line C-C in FIG. 7, FIG. 7 shows a detailed view of the upper portion of the hydraulic unit shown in FIG. 4, FIG. 8 shows a transversely cutaway plan view of the cross-sectional plane marked A-A in FIG. 3, FIG. 9 shows a detailed view of the middle section marked Z in FIG. 5, FIG. 10 shows the basic structure of a comminution device according to a first embodiment of the invention and the second aspect of the invention, in a longitudinal cross-sectional side view, FIG. 11 shows a section from FIG. 10, showing a first embodiment of the inventive lubrication mechanism according to the second aspect of the invention, FIG. 12 shows a second embodiment of the invention according to the second aspect, in a longitudinal cross-sectional side view, and FIG. 13 shows a perspective view from side and from the front, of the embodiment shown in FIG. 12.

Referring firstly to FIGS. 1 and 2, the principle of the comminution function of an inventive comminution device according to the first aspect of the invention shall now be described. The comminution device includes an inlet opening 110, through which liquids laden with solids are guided. The solids-laden liquid comes into contact with a ring-shaped perforated disk 120 provided with a plurality of openings through which the solids and the liquid can pass. The perforated disk is fixedly mounted on a discharge casing 130, into which the solids-laden fluid enters after the solids therein have been comminuted and can leave said discharge casing in the radial direction through a discharge opening.

A blade holder 140 having a total of four blades 141 *a-d* is arranged on the side of perforated disk 120 facing towards the inlet opening. Blades 141 *a-d* lie with their cutting edges on the surface 121 of perforated disk 120 facing towards the inlet opening. Each blade 141 *a-d* extends in the radial direction from a rotational axis 100 concentric with the central longitudinal axis of perforated disk 120.

Blade holder 140, with blades 141 *a-d* attached thereto, is set in rotational motion about said rotational axis 100 by means of a hollow drive shaft 150, as a result of which the blades glide rotatingly on a circular path on perforated disk 120. This produces a shearing effect between the blade edges and the boundary edges of the holes within the perforated disk, which leads in turn to comminution of the solids entering the holes.

The rotary motion is transferred by hollow shaft 150 onto blade holder 140 via a shaft-hub connection 151. The shaft-hub connection allows blade holder 140 to move axially in relation to hollow shaft 150.

Hollow shaft 150 is driven by a drive motor 190 and transfers the rotational movement to blades 141 *a-d*.

Drive shaft 150 is embodied as a hollow shaft and transmits the torque by means of a splined shaft connection 154 to blades 141 *a-d*. Blades 141 *a-d* can move in the axial direction, but are guided torque-resistantly in relation to hollow shaft 150 in the splined shaft connection 154 and as a result can perform an adjusting movement of cutting blades 141*a, b* onto cutting screen 120.

A pull rod 160 is guided in hollow shaft 150. Pull rod 160 transfers the axial tensioning and adjusting force from an adjusting drive device provided for this purpose at the axial end 161 of pull rod 160 onto blade holder 140.

The adjusting drive device comprises a cylinder 165 which is fixedly connected to the hollow shaft and in which a piston 166 is mounted axially displaceably. Piston 166 is fixedly connected to pull rod 160. A hydraulic connection element 167 is attached to piston 160, by means of which hydraulic fluid can be pressed under pressure into the interspace 168 between piston 166 and cylinder 165. FIG. 1 shows the comminution device according to the invention in a state with unworn, new cutting elements 141 *a, b*, 120. From the position shown, piston 166 can lift upwards from cylinder 165, thereby pulling pull rod 160 out of hollow shaft 150 in the direction of arrow 102, as a result of which cutting blades 141 *a, b* are moved in the direction of cutting screen 120.

A cavity 180 into which lubricant can be filled externally via a lubrication nipple 182 and a lubrication bore 181 is arranged between a ring-shaped end face 153 at that end of shaft 150 which is in the region of blades 141*a-d* and a ring-shaped bottom face 163 in a blind hole in blade holder 140 for accommodating said drive shaft end. This cavity changes its volume due to end faces 153, 163 coming closer together when an adjusting movement of blade holder 140 is made in the direction of arrow 101. Lubricant in cavity 180 is pressed as a result into lubrication slit 183 in the region of the splined shaft connection, and thus reliably ensures the mobility and reliable adjustment motion of cutting blades 141*a-d* at all times in relation to cutting screen 120.

A single-action linear hydraulic cylinder 210 acts on pull rod 160. Hydraulic cylinder 210 is coupled to pull rod 160 in such a way that, when pressure is applied to the hydraulic cylinder and the hydraulic cylinder extends as a result, a pulling force which presses cutting blades 141*a-d* onto cutting screen 120 is transferred to pull rod 160.

FIG. 3 shows the structure of the hydraulic system in schematic form. Hydraulic cylinder 210 is connected by means of a nonreturn valve 211 arranged in parallel and a choke 212 to a variable-level pressure vessel 220. Hydraulic oil which also fills the connection line to hydraulic cylinder 210 and the pressurised side thereof is disposed in a bottom portion 220*a* of variable-level pressure vessel 220.

Variable-level pressure vessel 220 also has an air volume 220*b* which is about equal in volume to the oil in the vessel. An oil level 221 is formed between air volume 220 *b* and hydraulic oil volume 220 *a*.

Variable-level pressure vessel 220 also has a scale 222 and is embodied as a pressure-resistant glass beaker with a metal cap, such that the level of the interface between air and hydraulic oil can be read off externally. A scale 222 which allows the level to be assigned to the extension of hydraulic cylinder 210 is provided on the glass beaker. This extension state of hydraulic cylinder 210 corresponds, in turn, to an adjustment path and hence to a wear condition of cutting blades 141 *a-d* and of cutting screen 120. The wear condition of the cutting blades and of the cutting screen is visualised on the scale by the hydraulic oil level, as the cumulative wear of both sides.

The air-filled portion 220*b* of variable-level pressure vessel 220 is connected by means of a compressed air line 231 to a compressed air vessel 230. An adjustable pressure-reducing valve 232 is inserted into compressed air line 231. This pressure-reducing valve 232 allows the compressed air vessel or the variable-level pressure vessel 220 to be selectively connected to the ambient pressure. Compressed air vessel 230 and variable-level pressure vessel 220 can also be connected simultaneously to the ambient pressure via pressure-reducing valve 232. In a normal operating position, pressure-reducing valve 232 connects the compressed air vessel to the variable-level pressure vessel and shuts off both vessels from the surroundings. In this normal operating position, a constant pressure is maintained in the variable-level pressure vessel, even when the air volume as a whole expands due to an increase in volume resulting from the piston being displaced in hydraulic cylinder 210, as long as the pressure in compressed air vessel 230 is greater than that in variable-level pressure vessel 220.

A manually operable air pump 240 is connected via a nonreturn valve 241 to compressed air vessel 230 and attached thereto. By means of air pump 240, a desired internal pressure can be produced in the compressed air vessel in order to generate, by means of the hydraulic oil in the closed hydraulic and pneumatic system, a compressive pressure between cutting blades 141 *a-d* and perforated disk 120.

FIGS. 4 to 9 show different views of the hydraulic unit of the inventive comminution device. As one can see, the hydraulic unit includes a glass beaker 225 which has a connector 226 at the bottom for connecting it to hydraulic cylinder 210. Scale 222 is printed on the glass wall of glass beaker 225.

Glass beaker 225 is sealingly attached by means of a screw connection 227 to a casing body 235. Compressed air vessel 230 is disposed as a cavity in casing body 235 and sealed by means of a top cover 236.

As can be seen from FIGS. 5 and 8, in particular, compressed air vessel 230 can be pressurised with compressed air either by means of a manually operated air pump 240, or alternatively via a compressed air connection 250.

Compressed air vessel 230 is connected to the variable-level pressure vessel by means of a longitudinal bore 233 which opens into a transverse bore 234 and by a diagonal bore 228. A valve inlet which can be externally operated and which allows either the compressed air vessel or the variable-level pressure vessel to be connected to ambient pressure, or the compressed air vessel and the variable-level pressure vessel to be connected to each other and shut off from the ambient pressure is inserted into transverse bore 234.

Two manometers 261, 262 are also arranged on the hydraulic unit. The upper manometer 261 indicates the air pressure in compressed air vessel 230. The lower manometer 262 indicates the pressure in the variable-level pressure vessel.

Referring firstly to FIG. 10, the principle of the comminution function of an inventive comminution device according to the second aspect of the invention shall now be described. The comminution device includes an inlet opening 310, through which liquids laden with solids are guided and which is laterally defined by a tubular casing 311. The solids-laden liquid comes into contact with a ring-shaped perforated disk 320 provided with a plurality of openings through which the solids and the liquid can pass. The perforated disk is fixedly mounted on a discharge casing 330, into which the solids-laden fluid enters after the solids therein have been comminuted and can leave said discharge casing in the radial direction through a discharge opening 331.

A blade holder 340 having a total of four blades 341*a, b* is arranged on the side of perforated disk 320 facing towards the inlet opening. Blades 341*a, b* lie with their cutting edges on the surface 321 of perforated disk 320 facing towards the inlet opening. Each blade 341*a, b* extends in the radial direction from a rotational axis 300 concentric with the central longitudinal axis of perforated disk 320.

Blade holder 340, with blades 341*a, b* attached thereto, is set in rotational motion about said rotational axis 300 by means of a drive shaft 350, as a result of which the blades glide rotatingly on a circular path on perforated disk 340. This produces a shearing effect between the blade edges and the boundary edges of the holes within the perforated disk, which leads in turn to comminution of the solids entering the holes.

The rotary motion is transferred by shaft 350 onto blade holder 340 via a shaft-hub connection 351. The shaft-hub connection allows axial movement on the part of blade holder 340 in relation to shaft 350, which is used used by a plurality of a tension springs 360*a, b* arranged eccentrically in the axial direction in relation to shaft 350 to press blades 341*a, b* with a defined biasing force onto surface 321 of perforated disk 320. A ball locking mechanism 370 prevents the blades from jumping back out of the position abutting perforated disk 320 and thus achieves permanent contact between the blades and the perforated disk.

Shaft 350 is driven by a drive motor 390 and transfers the rotational movement to blades 341*a, b*.

FIG. 11 shows, in detail, the automatic lubrication of the surfaces formed in the positive engagement connection and which are moved relative to one another. As can be seen, a cavity 380 is formed between the end face 352 of shaft 350 and the end-face bottom 342 of a blind hole in blade holder 340, in which blind hole shaft end 350*a* of shaft 350 is accommodated. Cavity 380 is connected via a through bore 380 to a lubrication nipple facing towards inlet opening 310 and can be filled with grease via lubrication nipple 382 and through bore 381.

A positively interlocking shaft-hub-connection is formed between shaft 350 and blade holder 340 by a longitudinal groove 353 in the shaft and a matching longitudinal groove 343 in the blind hole in blade holder 340, and by means of a tongue 354 with fits into these two grooves 353, 343. The shaft-hub connection is designed in such a way that axial displaceability between blade holder 340 and shaft 350 is possible, wherein tongue 354 remains in the fixed position in relation to the shaft, as shown in FIG. 11, and blade holder 340 can move in the axial direction relative to shaft 350 and tongue 354. FIG. 11 shows the starting position with a newly inserted blade 341*a* and a newly inserted perforated disk 320, with maximum volume of cavity 380. Blade holder 340 can also move along shaft 350 from the position shown in FIG. 11 in the pulling direction of spring 360. Cavity 380 is reduced in volume by this movement, and blades 341*a, b* are moved in the direction of perforated disk 320.

A lubrication slit 383 which allows lubricant to enter from cavity 380 is formed between the circumferential inner walls 346 of the blind hole in blade holder 340 and the circumferential wall 356 of shaft 350. Lubrication slit 383 is so small in its dimensions that lubricant is prevented from escaping undesiredly from cavity 380, while also allowing the lubricant to enter this lubrication slit when cavity 380 is reduced in volume by relative axial movement between shaft 350 and blade holder 340, with lubricant being pressed out of the cavity as a result. By adjusting blade holder 340 in the pulling direction of tension springs 360 in order to compensate for wear on blades 341*a, b* and/or perforated disk 320, the volume of cavity 380 is reduced and grease is pressed into lubrication slit 383, as a result of which the shaft-hub connection achieved with tongue 354 is kept mobile at any time during operation, thus ensuring reliable adjustment of blades 341*a, b* in relation to perforated disk 320.

FIGS. 12 and 13 show a second embodiment of the invention. In this embodiment, drive shaft 450 is embodied as a hollow shaft and transmits the torque by means of a splined shaft connection 454 to blades 441*a-d*. Blades 441*a-d* can move in the axial direction, but are guided torque-resistantly in relation to hollow shaft 889.00 cm the splined shaft connection 454 and as a result can perform an adjusting movement of cutting blades 441*a, b* onto cutting screen 420.

A pull rod 460 is guided in hollow shaft 450. Pull rod 460 transfers the axial tensioning and adjusting force from an adjusting drive device (not shown) provided at the axial end 461 of pull rod 460 onto an adjusting pressure element 462. In a first, simple configuration, this pulling force can be achieved by pull rod 460 being embodied as a threaded rod and screwed into an external thread in adjusting pressure element 462, thus producing axial movement of adjusting pressure element 462 when pull rod 460 is rotated accordingly, while said pull rod 460 is simultaneously axially fixed. In an alternative configuration, the pull rod can also be fixedly attached in adjusting pressure element 462, for example by being screwed into it, and a pulling force and movement can be exerted and effected by an axial movement of the pull rod itself, for example by means of a worm which engages with the thread.

A cavity 480 into which lubricant can be filled externally via a lubrication nipple 482 and a lubrication bore 481 is arranged between a ring-shaped end face 453 at that end of shaft 450 which is in the region of blades 441*a-d* and a ring-shaped bottom face in a blind hole in adjusting pressure element 462 for accommodating said drive shaft end. This cavity changes its volume due to end faces 453, 463 coming closer together when an adjusting movement of adjusting pressure element 462 is made in the direction of arrow 401. Lubricant in cavity 480 is pressed as a result into lubrication slit 483 in the region of the splined shaft connection, and thus reliably ensures the mobility and reliable adjustment motion of cutting blades 441 *a-d* at all times in relation to cutting screen 420.

The invention claimed is:

1. A comminution device, comprising:

a first cutting element, including at least one first cutting edge, a second cutting element which is movable on a first path of movement relative to the first cutting element and which has at least one second cutting edge, wherein the second cutting element lies against the first cutting element in such a way that the relative movement of the second cutting element along the first path of movement produces a shearing action between the at least one first cutting edge and the at least one second cutting edge, an adjusting mechanism which adjusts the second cutting element relative to the first cutting element on a second path of movement in such a way that the second cutting element is moved closer for permanent contact with the first cutting element when at least one of the first or second cutting elements wears down as a result of the relative movement along the first path of movement, wherein the adjusting mechanism has a leak-free hydraulic cylinder which is coupled mechanically and functionally between the first and the second cutting elements in order to bring about an adjusting movement between the first and the second cutting elements by actuating the hydraulic cylinder and to cause the first and second cutting elements to contact each other by application of pressure to the hydraulic cylinder, and in that the hydraulic cylinder is in hydraulic communication with a closed hydraulic and pneumatic volume which includes a pressure vessel, the volume of which is filled with a hydraulic fluid in a first part and with air in a second part, and the wall of which is at least partially transparent so that the hydraulic fluid level can be read from a scale which defines the boundary region ensuing during operation between an air volume fraction and a hydraulic fluid volume fraction in the closed hydraulic and pneumatic volume and displays a wear condition of the first and second cutting element.

2. The comminution device according to claim 1, wherein the closed hydraulic and pneumatic volume is connected via a compressed air line having a nonreturn valve to an air pump or to a compressed air inlet for pressurising the pressure vessel with compressed air, and the nonreturn valve acts in such a way that it prevents a volumetric flow from the pressure vessel to at least one of the air pump or the compressed air inlet.

3. The comminution device according to claim 2, wherein the pressure vessel and the air pump are integrally formed on a pressure unit, and the air pump includes a piston which is connected via a piston rod to a handle for manual operation, and further includes a cylinder which sealingly accommodates the piston and which is preferably attached pivotably to the pressure unit.

4. The comminution device according to claim 2, wherein the pressure vessel includes a first pressure vessel which comprises the first part, the second part, the wall, and the scale; and includes a compressed air vessel which is connected via a compressed air line to the second part, and in that the compressed air vessel is in communication with the air pump and the compressed air connection via an adjustable pressure-reducing valve.

5. The comminution device according to claim 4, wherein the adjustable pressure-reducing valve can be adjusted to at least one of the following valve positions:

a first position, in which the compressed air vessel and the first pressure vessel are connected to each other and isolated from the ambient pressure, a second position, in which the compressed air vessel is connected to the ambient pressure and the first pressure vessel is isolated from the ambient pressure and the compressed air vessel, a third position, in which the first pressure vessel is connected to the ambient pressure and the compressed air vessel is isolated from the ambient pressure and the compressed air vessel, a fourth position, in which the first pressure vessel and the compressed air vessel are connected to the ambient pressure, a fifth position, in which the first pressure vessel is isolated from the compressed air vessel and the first pressure vessel and the compressed air vessel are isolated from the ambient pressure, wherein the adjustable pressure-reducing valve, when in any of the first, second, third or fourth positions, adjusts the pressure in the first pressure vessel to a lower pressure than that in the compressed air vessel.

6. The comminution device according to claim 1, wherein the hydraulic cylinder is adjustable between a first position, in which the first and second cutting elements lie against each other when in an unworn, new condition, and a second position, in which the first and second cutting elements lie against each other in a worn, used condition requiring replacement, said hydraulic cylinder changing its volume hydraulically between the two positions, and in that these changes in volume amount to at most 20% of the air volume fraction in the closed hydraulic and pneumatic volume.

7. The comminution device according to claim 1, wherein the hydraulic cylinder is adjustable between a first position, in which the first and second cutting elements lie against each other when in an unworn, new condition, and a second position, in which the first and second cutting elements lie against each other in a worn, used condition requiring replacement, said hydraulic cylinder changing its volume hydraulically between the two positions, and in that the pressure vessel includes, in the region of the scale, a cross-sectional area along the hydraulic fluid level, which is at most so large that the relationship between the hydraulic change in volume of the hydraulic cylinder and the cross-sectional area is greater than 1 cm.

8. The comminution device according to claim 1, wherein the second cutting element includes a blade which rotates on the surface of the first cutting element along the first path of movement, and a positive engagement connection is formed between a blade holder which accommodates the blade and a drive shaft which drives the blade.

9. The comminution device according to claim 1, wherein the second cutting element is a rotating cutting element the hydraulic cylinder acts on a transmission rod which transfers an adjusting force to the second cutting element, and the transmission rod is guided inside a hollow shaft which transfers a rotary motion from a drive motor to the second cutting element, and in that the first cutting element is formed by a cutting screen having a plurality of openings whose boundary edges form cutting edges along which the second cutting element is rotatingly moved in such a way that a shearing action is produced between the first cutting element and the cutting edges of the second cutting element.

10. The comminution device according to claim 1, wherein a positive engagement connection is formed between the second cutting element and a hollow shaft for transferring the cutting force along the first path of movement, said hollow shaft being formed by positive engagement in a circumferential direction in order to transfer the driving force required for the first path of movement and being movable in an axial direction in order to perform an adjusting movement along the second path of movement.

11. The comminution device according to claim 10, wherein a lubricant-filled cavity is formed between a first area coupled to the first cutting element or to a component coupled to the first cutting element and a second area coupled to the second cutting element or to a component coupled to the second cutting element, the volume of said cavity being reduced by an adjusting movement of the second cutting element along the second path of movement and said cavity being in fluidic communication with the positive engagement connection in order to supply lubricant to the positive engagement connection.

12. The comminution device according to claim 11, wherein the lubricant-filled cavity is connected to a lubrication nipple for feeding lubricant into the cavity.

13. The comminution device according to claim 1, wherein the second path of movement lies perpendicular to the first path of movement.

14. The comminution device according to claim 1, wherein the first cutting element is a perforated disk and includes a plurality of first cutting edges formed by openings in walls defining the perforated disk, and the second cutting element includes a blade which rotates on the surface of the perforated disk along the first path of movement.

15. The comminution device according to claim 8, wherein the positive engagement connection is a positively interlocking shaft-hub connection between a shaft which drives the second cutting element and a hub body which holds the second cutting element, the shaft-hub connection being either a splined shaft connection or a tongue and groove connection.

16. The comminution device according to claim 1, wherein the first path of movement is a closed circular path.

17. The comminution device according to claim 1, wherein a lubricant-filled cavity is arranged, between an axial end face of a drive shaft driving the first cutting element and connected by positive engagement to the first cutting element via a positive engagement connection, and an axial end face of a holder for the first cutting element, said holder being connected to said first cutting element and mounted moveably and axially displaceably relative to the drive shaft in the positive engagement connection.

18. The comminution device according to claim 17, wherein the lubricant-filled cavity is connected to a lubrication nipple for feeding lubricant into the cavity.

* * * * *

UNITED STATES PATENT AND TRADEMARK OFFICE

CERTIFICATE OF CORRECTION

PATENT NO. : 9,073,056 B2
APPLICATION NO. : 13/821260
DATED : July 7, 2015
INVENTOR(S) : Michael Abeln It is certified that error appears in the above-identified patent and that said Letters Patent is hereby corrected as shown below:

Title Page, Item (30) Foreign Application Priority Data, application numbers should read

--20 2010 012 373.9-- and

--20 2010 12 495.6--

Signed and Sealed this
Seventeenth Day of May, 2016

Michelle K. Lee

Michelle K. Lee
*Director of the United States Patent and Trademark Office*